United States Patent [19]

Armelin

[11] Patent Number: 4,810,153

[45] Date of Patent: Mar. 7, 1989

[54] MACHINE FOR RECEIVING AND STACKING BLANKS OF CARDBOARD OR LIKE MATERIAL OF VARIABLE SHAPE AND FORMAT, SUCCESSIVELY CUT OUT FROM A CONTINUOUS WEB

[75] Inventor: Michaël Armelin, London, Great Britain

[73] Assignee: Machines Chambon, Orleans, France

[21] Appl. No.: 43,141

[22] Filed: Apr. 27, 1987

[30] Foreign Application Priority Data

Apr. 29, 1986 [FR] France ..... 86 06244

[51] Int. Cl.[4] ..... B65H 29/60

[52] U.S. Cl. ..... 414/790.1; 271/302; 414/794.9; 414/796

[58] Field of Search ..... 271/212, 302, 198; 414/92, 114, 43; 198/463.3

[56] References Cited

U.S. PATENT DOCUMENTS

| | | | |
|---|---|---|---|
| 2,533,184 | 12/1950 | Trump | 271/302 |
| 3,067,851 | 12/1962 | O'Rourke, Jr. | 198/463.3 |
| 3,543,651 | 12/1970 | Donahue et al. | 93/93 |
| 3,866,765 | 2/1975 | Stobb | 271/212 X |
| 4,015,840 | 4/1977 | Schröder | 271/302 |
| 4,174,774 | 11/1979 | Bourgeois | 198/463.3 X |
| 4,195,831 | 4/1980 | Sutera | 271/302 |
| 4,283,048 | 8/1981 | Müller | 271/302 |
| 4,458,892 | 7/1984 | Nozawa | 271/212 X |
| 4,620,827 | 11/1986 | Sameshima et al. | 414/114 |

FOREIGN PATENT DOCUMENTS

| | | | |
|---|---|---|---|
| 727488 | 2/1966 | Canada | 271/212 |
| 0118849 | 9/1984 | European Pat. Off. . | |
| 485168 | 10/1929 | Fed. Rep. of Germany . | |
| 1051868 | 3/1959 | Fed. Rep. of Germany | 271/212 |
| 1207200 | 12/1965 | Fed. Rep. of Germany . | |
| 2006750 | 1/1970 | France . | |
| 0167850 | 8/1985 | Japan | 414/114 |
| 2034285 | 6/1980 | United Kingdom . | |

*Primary Examiner*—Frank E. Werner
*Assistant Examiner*—Janice Krizek
*Attorney, Agent, or Firm*—McAulay, Fields, Fisher, Goldstein & Nissen

[57] ABSTRACT

A machine for receiving and stacking blanks of cardboard or like material, of variable shape and format, cut out successively from a continuous web by a cutting-out apparatus located upstream of the machine, supplied in "scales" on an endless conveyor belt, overlapping one another, comprises a device for deviating the blanks through at least 90°. This device comprises a drum of horizontal and transverse axis around which pass mobile endless belts extending up to a stacking stop, and passing around a motorized drive roller and guide rollers. At least one of the guide rollers is borne by a chassis mounted to pivot about the drum, so that the pivoting chassis may occupy two positions, namely a first horizontal position and a second vertical position.

20 Claims, 5 Drawing Sheets

MACHINE FOR RECEIVING AND STACKING BLANKS OF CARDBOARD OR LIKE MATERIAL OF VARIABLE SHAPE AND FORMAT, SUCCESSIVELY CUT OUT FROM A CONTINUOUS WEB

BACKGROUND OF THE INVENTION

The present invention relates to a machine for receiving and stacking blanks of cardboard or like material, of variable shape and format, successively cut out from a continuous web, by a cutting-out apparatus located upstream of the machine, supplied in "scales" on a conveyor, overlapping one another.

Various machines are known at the present time for receiving blanks of cardboard which are cut out from a continuous web of cardboard by a rotating or flat cutting out apparatus located upstream. These cardboard blanks, on which lines of fold have also been marked, are intended subsequently to constitute packings for various products.

A stacking process is also known, employed in the newspaper industry, which consists in returning on itself, through 180°, a continuous line of successive newspapers overlapping one another, to stack them in the upper part of the machine for receiving the newspapers. In this process, the newspapers engage successively at the base of the stack of newspapers previously formed. Consequently, the stack is developed continuously from its base. Such a process, applied to the staacking of exercise books, i.e. of sheets folded on themselves and superposed, is also described in British Pat. No. 2.034285. Such a process, although it is suitable for newspapers or sheets of booklets folded on themselves, of regular rectangular format, cannot be employed as such for stacking blanks of cardboard cut out in short series from blanks having irregular profiles and a variable format from one series to the other.

The present invention aims at adapting this process of stacking in a machine making it possible, depending on the number of blanks of a particular number of copies, i.e. depending on whether it is a question of receiving successive blanks forming part of a series of a large number or of a small number of blanks, either automatically to form and evacuate stacks of a predetermined number of blanks, in order to facilitate subsequent take-up of the piles of blanks, as a function of their use downstream, or to allow the blanks to leave continuously one after the other, to allow easy manual take-up of the blanks.

SUMMARY OF THE INVENTION

To this end, this machine for receiving and stacking blanks of cardboard or like material, of variable shape and format, cut out successively from a continuous web by a cutting-out apparatus located upstream of the machine, supplied in "scales" on an endless conveyor belt, overlapping one another, comprising a device for deviating the blanks through at least 90°, parallel, mobile endless belts extending between the outlet of the blank deviating device and a transverse stacking stop which stops the successive blanks which engage one after the other the stack of blanks already formed, the blank deviating device comprising a drum of horizontal and transverse axis around which pass the mobile endless belts extending up to the stacking stop, the conveyor belt being tangential to the drum, therebeneath, and passing around a motorized drive roller and guide rollers of horizontal and transverse axes, is characterized in that at least one of the guide rollers is borne by a chassis mounted to pivot about the drum, so that the pivoting chassis may occupy two positions, namely a first horizontal position in which it extends longitudinally in the axis of the machine, so that the conveyor belts extends horizontally outside the machine, to allow a continuous outlet, in the horizontal direction of the line of blanks and a second vertical position in which the conveyor belt is maintained applied against at least the lower quarter of the peripheral surface of the drum located ouside the machine with respect to a vertical diametral plane of the drum, so that, when the pivoting chassis is in this second vertical position, each line of blanks is driven between the conveyor belt and the mobile endless belts along the lower and outer quarter at least of the peripheral surface of the drum to be deviated through at least 90° and then be directed, by the mobile endless belts, towards the stacking stop.

The machine according to the invention is provided with a central control apparatus which synchronizes the operation of the various actuating members, such as jacks, and which makes it possible automatically to trigger off the cycle of release and lateral evacuation of a stack when this stack has attained the desired number of blanks. As the blanks constituting each stack arrive successively underneath this stack, the height of the stacks is not limited.

The machine according to the invention thus offers the advantage that it may be used very conveniently in two different ways, namely by furnishing at its outlet, a continuous line of blanks in "scales", in the horizontal and longitudinal direction, or by furnishing, after deviation of the blanks, stacks of blanks of variable height, these stacks being evacuated laterally which facilitates subsequent use thereof on packing machines. The first case, i.e. horizontal outlet in the axis of the machine, is particularly advantageous when it is a question of a short series of blanks: in fact, the adjustments of the machine do not need to be modified. Furthermore, intervention on the drum is easy when the pivoting chassis extends horizontally, in the event of jamming of the blanks.

The machine according to the invention also lends itself well to the formation of stacks of blanks increasing in the horizontal direction (with deviation of the line of blanks through 90°) or in a direction inclined by any angle greater than 90° with respect to the horizontal direction of supply of the blanks.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1A:
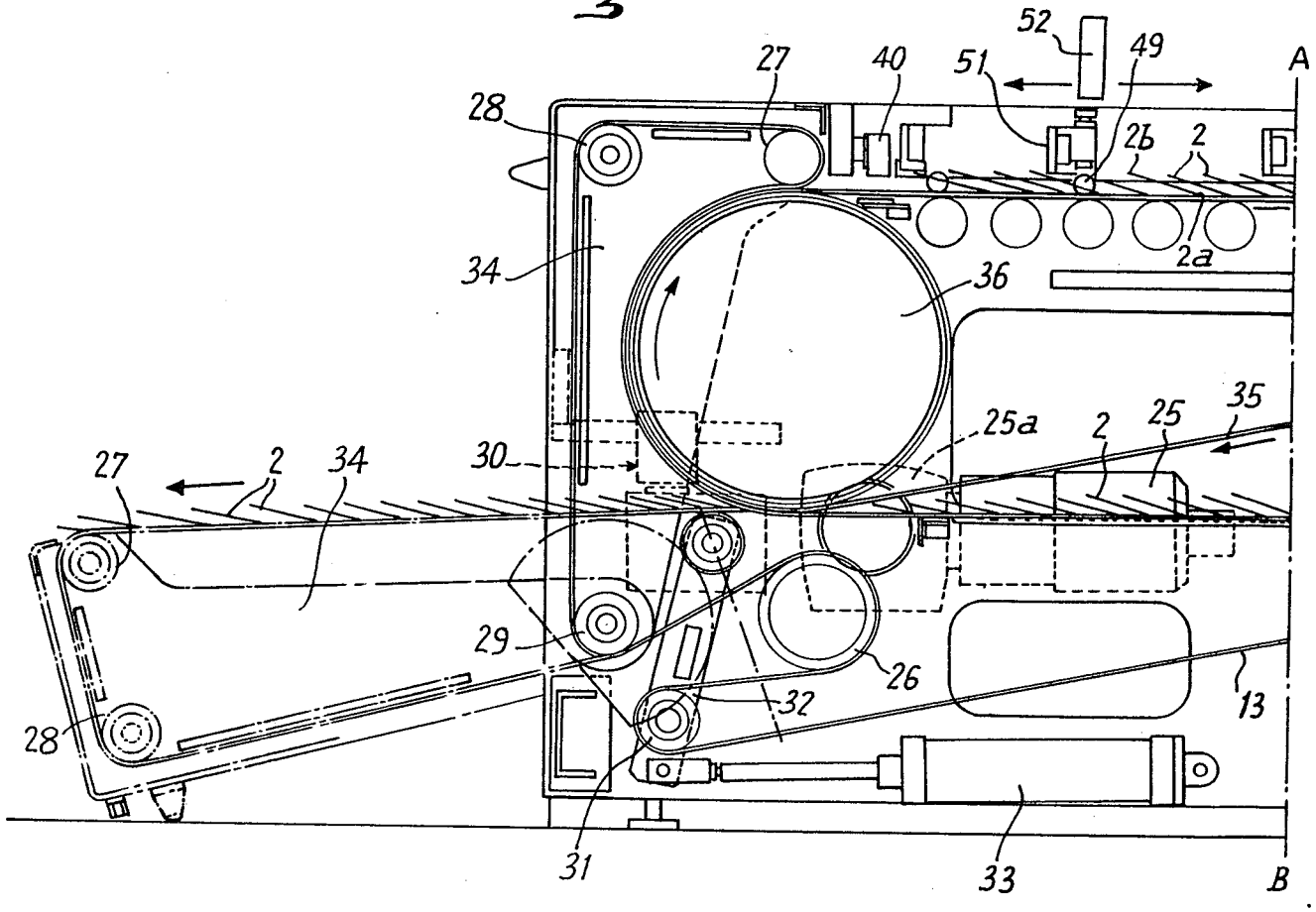
FIGS. 1A and 1B, joined together along line A-B, constitute a view in vertical and longitudinal section of a machine according to the invention for receiving and stacking cut-out blanks.
Figure 1B:
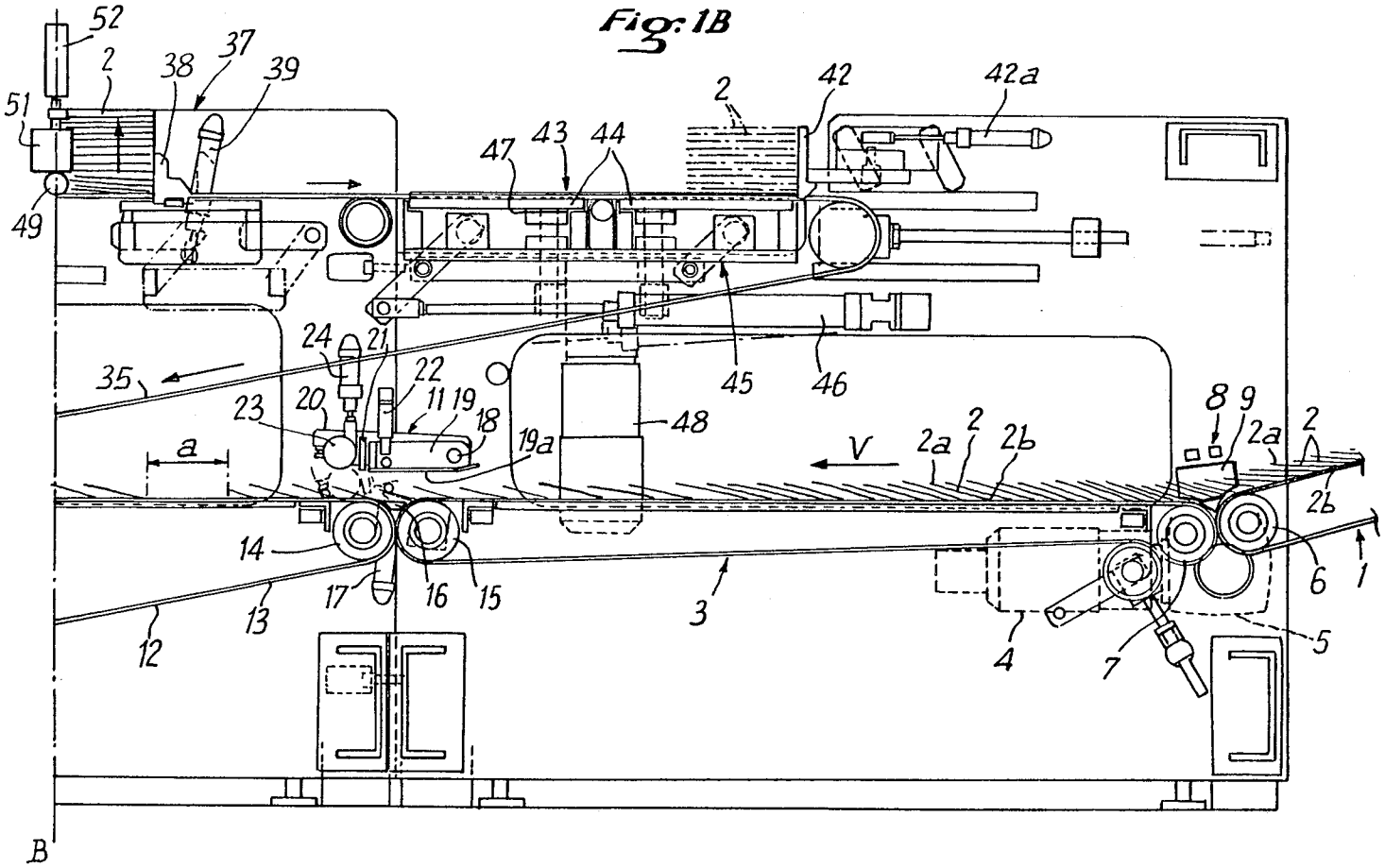
Figure 2:
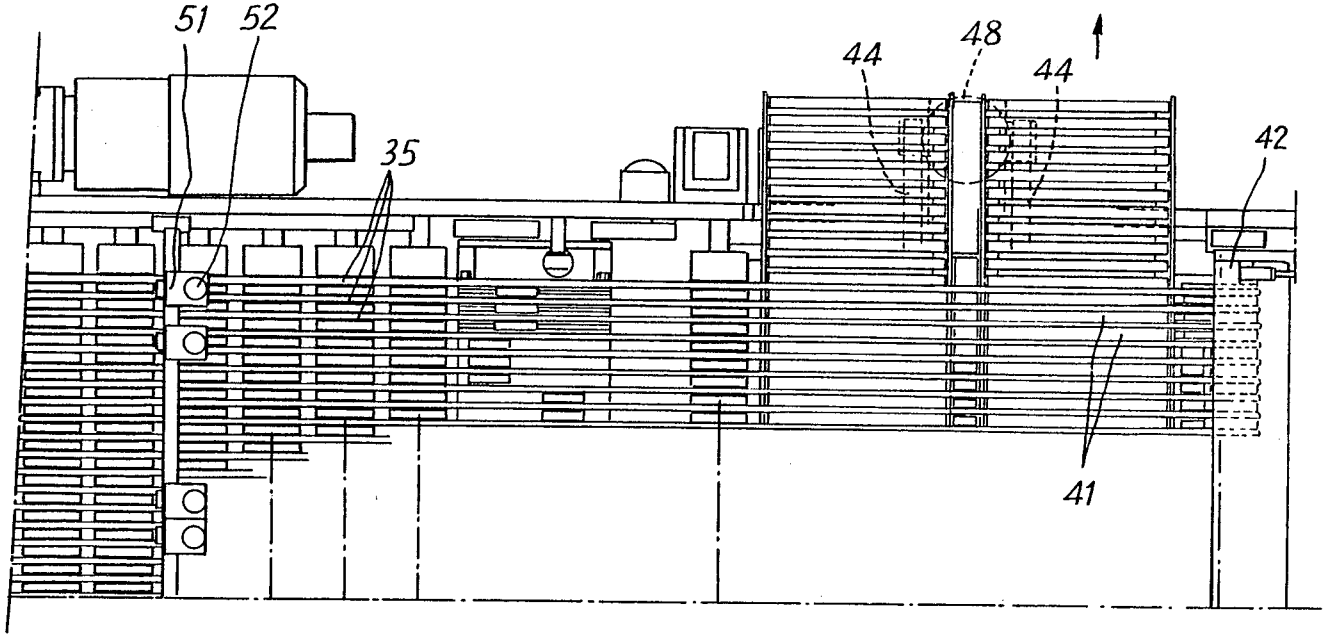
FIG. 2 is a partial plan view of the machine.

Referring now to the drawings, the machine according to the invention, shown in FIGS. 1A and 1B, comprises an upstream conveyor belt 1 of the endless type, on the upper side of which are displaced, from right to left, blanks 2 overlapping one another. These blanks 2 which may for example be previously cut-out cardboard blanks for subsequently constituting packings and printed on their upper faces, form "scales" on the upper side of the conveyor 1, in other words the front edge 2*a* of any blank 2 is placed above a preceding blank 2 whilst its rear edge 2*b*, which is in contact with the conveyor belt, lies beneath the following blank 2. These blanks 2 are obtained by being cut out, upstream, from a continuous web by means of a cutting-out apparaus of any known type. They constitute, on the upstream conveyor, a single longitudinal line or several parallel lines distant from one another.

The blanks 2 in "scales" are taken to an intermediate horizontal endless conveyor belt 3. The upstream conveyor belt 1 and the intermediate conveyor belt 3 are both driven, at the same linear speed V, by a motor 4 coupled, via a transmission mechanism 5, to rollers 6 and 7 ensuring drive respectively of the upstream conveyor belt 1 and of the intermediate conveyor belt 3. Above the drive rollers 6 and 7 of the conveyor belts 1 and 3, there is disposed a transverse edge-aligning device 8 of any known type, which comprises, per line of blanks 2, a pair of vertical and longitudinal plates 9, animated by a reciprocating transverse movement and coming into contact with the longitudinal edges of the blanks 2, in order to align each line of blanks 2.

The blanks 2 which are conveyed in "scales" from right to left on the upper side of the intermediate conveyor belt 3, then arrive at a device 11 which is provided to separate the continuous line of blanks 2 into successive groups of blanks each corresponding to a predetermined number of blanks intended subsequently to form an individual stack. This device 11 is placed at the joint of the intermediate conveyor belt 3 and a downstream return conveyor 12 which comprises an endless conveyor belt 13 passing over an upstream guide roller 14 of horizontal and transverse axis, which extends opposite and at the same level as another downstream guide roller 15 of horizontal and transverse axis, provided for the intermediate conveyor belt 3.

The device which is provided for the separation of thin articles such as cardboard blanks, comprises a lower catch 16, normally located between the two rollers 14,15, flush with the upper sides of the two conveyor belts 3 and 13 or beneath these sides and which may be raised by a jack 17. Above the guide rollers 14 and 15 is articulated, around a horizontal, transverse axis 18, a first pivoting lever 19 which bears, in its lower part, a horizontal plate 19*a* and which is urged in clockwise direction, i.e. downwardly, by a spring 22. The device 11 also comprises a second lever 20 which is also articulated about axis 18, which bears at least one presser roller or cylinder 23, disposed above the conveyor belt 13, and a stop 21 adjustable in height with respect to the cylinder 23, and which may be lowered under the control of a jack 24. The first lever 19 is stopped, in its downward movement, by an appropriate stop provided on the second lever 20.

Consequently, when an appropriate counting device has detected the passage, plumb with the separating device 11, of the desired number of blanks 2 intended subsequently to constitute a stack, a central control apparatus provokes lowering, further to the supply of jack 24, of the two levers 19 and 20 and consequently of stop 21 and of the presser roller or cylinder 23. Simultaneously, the lower catch 16 is raised by jack 17, this catch in turn raising blanks 2, provoking a stopping thereof against the lowered stop 21 and allowing the other blanks located in front to move away. The stop 21 thus stops the first blank of the following group of blanks, intended to constitute the following stack, thus forming an empty space or "hole" a in the line of blanks. At the same time, the jack 24 has lowered the or each presser roller 23 in contact with the last blanks 2 of the preceding group to promote drive of these latter blanks of the preceding group by the conveyor belt 13. This conveyor belt 13 is then displaced, after an adjustable time, at a speed V1, greater than speed V of the intermediate conveyor belt 3, in order to avoid too great an accumulation of blanks against the stop 21, upon formation of the hole.

Stopping of the line of blanks by the stop 21 is thus effected by "shearing" or rupture of the continuity in the vertical direction, and not by pinching of this line of blanks.

After a predetermined period of time has passed, the central control apparatus provokes a lowering of the catch 16 and a raising of the stop 21 as well as of the presser roller 23, this having for its effect to release the first blanks of the following group which have been retained upstream of the stop 21, whilst stacking progressively. These first blanks are maintained downwardly by the plate 19*a* at the beginning of rise of the stop 21. The following group of blanks 2 then continues its displacement towards the left, passing from the intermediate conveyor belt 3 to the downstream conveyor belt 13 for deviating the blanks (return through 180° in this particular embodiment), this group then being separated from the preceding group by an empty space or "hole" a.

The endless conveyor belt 13 is driven by means of a motor 25 which is coupled to a roller 26 for driving the conveyor belt 13, via a transmission mechanism 25*a*.

The upper horizontal side of the downstream return conveyor belt 13 passes around the left half of the periphery of a return drum 36, of horizontal and transverse axis, located above the conveyor belt 13 and driven in rotation by the motor 25, via an appropriate connecting mechanism (not shown). It then passes over a first upper guide roller 27 tangential to the upper part of the drum 36, then successively over a second upper guide roller 28, located at the same level as the preceding one but offset towards the left, a third lower guide roller 29 located beneath the horizontal side of belt 13, then over the drive roller 26 and over a lower tension guide roller 31 with an adjustable position to adjust the tension of the conveyor belt 13, to return to the upstream guide roller 14. The lower tension guide roller 31 is borne b a pair of parallel arms 32 articulated about a horizontal and transverse axis, in their upper part, and which are actuated by a horizontal and longitudinal tension jack 33 mounted in the lower part of the frame of the machine.

The first and second upper guide rollers 27 and 28 for the conveyor belt 13 are mounted to rotate on a chassis 34 which is mounted to pivot on the frame of the machine, about a horizontal and transverse axis merged with that of the lower guide roller 29. The pivoting movement of the chassis 34 is controlled by a mechanism 30, provided on one side of the machine and which may be actuated manually or by a motor.

The chassis 34 may be broutht into a horizontal position, as indicated in the left-hand part of FIG. 1A, and in that case, the groups of blanks 2 leave horizontally, at the left-hand or downstream end of the machine, separated or not from one another by holes a formed previously by the separating device 11 without being turned, in other words with the printed faces of the blaanks facing upwardly. This horizontal position of the chassis 34 is suitable when it is a question of a short series of blanks or of blanks having an irregular shape not suitable for automatic stacking.

The chassis 34 may also be brought into a vertical position, as is also shown in FIG. 1A. In this vertical position, the downstream part of the upper side of the conveyor belt 13 is applied against an assembly of parallel endless belts 35, passing around the left half of the turning drum 36. The belts 35 may be constituted by cylindrical belts engaging in grooves, of semi-circular cross section, in the drum 36. The upper side of the conveyor belt is thus applied on that half of the peripheral surface of the drum 36 located to the left of the vertical diametrical plane and on which are wound the endless belts 35. Consequently, when the chassis 34 is in vertical position, the blanks 2 which are displaced from right to left on the upper side of the conveyor belt 13, are taken and pinched between the belts 35 on the one hand and the conveyor belt 13 on the other hand and they are thus driven, whilst remaining pinched and maintained with their respective spaced apart relationships, from the lowest generatrix of the drum 36 to its highest generatrix.

The jack 33 for adjusting the tension of the conveyor belt 13 is provided to take into account the variation in length of that part of the conveyor belt 13 extending between the lower generatrix of the drum 36 and the first upper guide roller 27, respectively in the two horizontal and vertical positions of the pivoting chassis 34. The jack 33 adjusts the position of the moble guide roller 31 so that the conveyor belt 13 always has a correct tension, whatever the position of the pivoting chassis 34.

After having turned through 180°, the blanks 2 are released in the upper part of the drum 36, at the spot where the latter is tangential to the first upper guide roller 27 of the conveyor belt 13. From that moment, the blanks 2 which have thus been turned through 180° are displaced from left to right by belts 35, in the direction of a stacking device 37 provided in the upper part of the machine. These blanks 2 are then in a reverse "scale" arrangement with respect to their arrangement in the lower part of the machine, i.e. the front edge **2*a* of a blank 2 is placed beneath a preceding blank and the rear edge 2*b* of this same blank 2 is placed above the following blank 2, as shown in the drawing. The blanks 2, thus turned though 180°, are displaced by the upper sides of the belts 35 up to a transverse stacking stop 38 forming part of the stacking device 37 and which may be retracted vertically beneath the belts 35, under the action of a mechanism controlled by a jack 39**.

To facilitate formation of the stacks, the machine may comprise, upstream of the stacking stop 38, at least one pressing roller (or plate) 49 mounted on a longitudinally adjustable support 51, this roller being adapted to be pressed downwardly by a jack or spring 52. This roller 49 is intended to exert a pressure on the blanks 2 located on the upper side of the belts 35, in an appropriate position varying longitudinally as a function of the format of the blanks 2, in order to facilitate introduction thereof in the base of the stack. The support 51 is also arranged to constitute a guiding of the upstream side of the stack in the course of formation thereof.

Consequently, the groups of blanks 2 which are brought by the upper sides of the belts 35, moving from left to right in FIG. 1B, come into contact with the transverse stop 38 by which they are stopped and due to their "scale" arrangement on the belts 35, they engage successively one beneath the other, forming a stack of progressively increasing height. When the photoelectric cell 40, mounted in the upper part of the machine, above the belts 35, for example in the vicinity of the guide drum 36, detects the passage of a hole a between two successive groups of blanks 2, this cell sends a signal to a central control apparatus (not shown) which triggers off, with an apropriate delay time, the process of evacuation. In other words, all the blanks of the group in the course of stacking, up to the last of this group, are allowed to move from the left to the right up to the stacking stop 38, to form the stack of blanks stopped in contact with this stop.

When the last blank 2 of the group of blanks in question has been engaged beneath the stack already formed, the central control apparatus provokes supply of the jack 39, to lower the retractable stacking stop 38. This stop 38 then releases the stack of blanks formed thereagainst, this stack being driven, by the belts 35, towards the right in FIG. 1B, until it meets a stop 42 for stopping the stacks. At that moment, the speed of the belts 35 has been reduced to the value V of the conveyor 3, in order not to convey the stacks at too high a speed, risking provoking deformation thereof.

This stop 42 is located just after a lateral evacuation device 43 comprising an assembly of rollers 44 extending longitudinally and which are borne by a support 45 vertically moble under the control of a jack 46. These rollers 44 of the lateral evacuation device 43 may be driven in rotation on themselves by means of endless drive bands 47 which are in contact with the lower parts of the rollers 44 and which are moved by a motor 48 via an appropriate transmission mechanism. At the moment when the stack of blanks arrives in contact with the stop 42 for evacuation of the stacks, the central control apparatus provokes lifting of the support 45 and of the evacuation roller assembly 44, then the spacing apart of the evacuation stop 42 by means of a jack **42*a*, then the electrical supply of the motor 48 to rotate these rollers 44. Due to the fact that the rollers 44 are lifted above the belts 35**, they come into contact with the lower face of the last blank of the stack formed, they raise this stack somewhat and, by their rotation, they provoke evacuation of the stack in the transverse direction on one side or the other of the machine. The stack of blanks may then be taken up by any handling chain.

In the variant embodiment of the invention shown in FIG. 3, the machine no longer comprises the device 11 intended to form separating "holes" between the successive groups of blanks subsequently forming individual stacks. In other words, the blanks 2 arrive on the upper sides of the belts 35, forming a continuous flow, the belt 13 in that case always moving at the same speed. Consequently, these blanks form, on contact with the stacking stop 38, a stack increasing without interruption.

In order to separate this continuously increasing stack into packets of blanks each comprising a predetermined number of blanks, there is provided, at the rear of the stop 38, at least one horizontal blade 53 adapted to be displaced horizontally and longitudinally above the stop 38, by a longitudinal jack 54. This blade 53, with rounded end, is adapted to be introduced horizontally and longitudinally in the stack in the course of formation, to separate it into two parts, namely a lower part P1 and an upper part P2. To facilitate introduction of the blade 53, a pusher 55 is provided, actuated by a jack 56 or any other appropriate control device, and which is disposed to the rear of stop 38, so as to raise the upper part P2 of the stack in the course of formation by its rear or right-hand side is located opposite the end of the blade 53. For the separator pusher 55 to be able to operate correctly, its inclination with respect to the vertical must be included between 15° and 30°. Consequently, when the jack 56 is supplied, the separator pusher 55 is displaced upwardly and to the left, it comes into contact with the right-hand side of a blank of the stack under formation, and it raises this blank slightly, as well as the upper part P2 of the stack. At that moment, the jack 54 displaces the blade 53 towards the left so that this blade 53 engages between the lower part P1 of the stack comprising the continuously arriving blanks 2, and the upper part P2 which comprises the packet of blanks resting on the blade 53. It is then possible to take up, by any appropriate means, the upper packet of blanks P2 which is thus separated from the lower packet P1 which constitutes a stack still in the course of formation.

Figure 3:
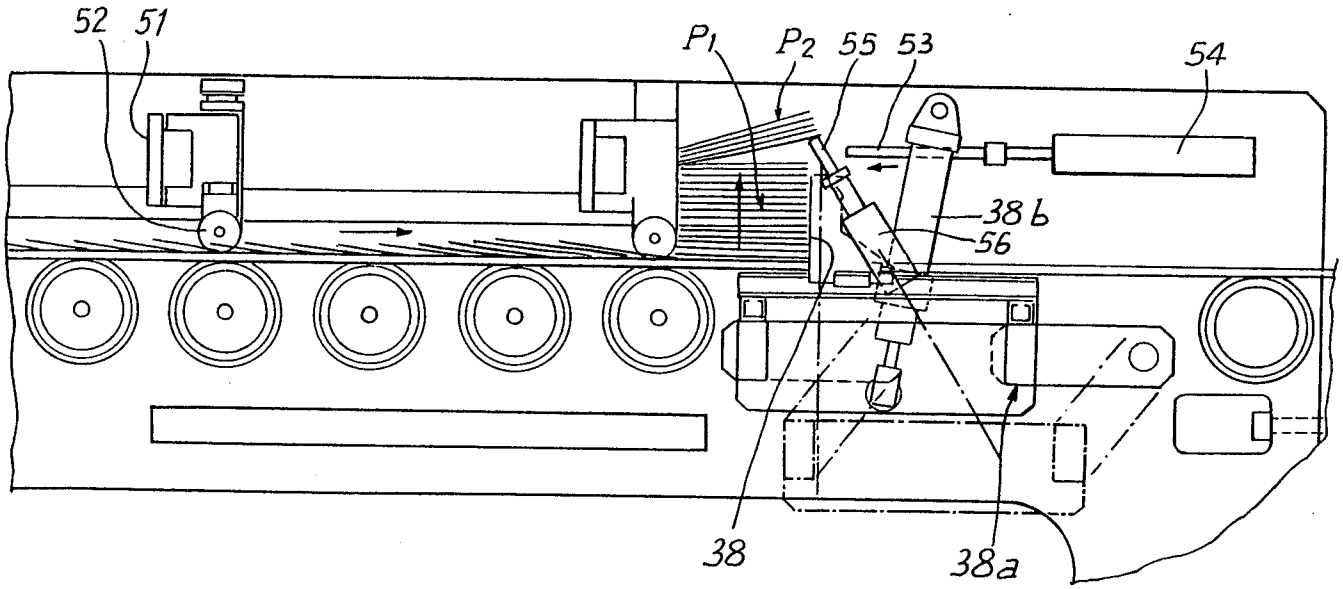
FIG. 3 is a view in vertical and longitudinal section of a variant embodiment of the device for lateral evacuation of the stacks of blanks provided in the upper part of the machine.
Figure 4:
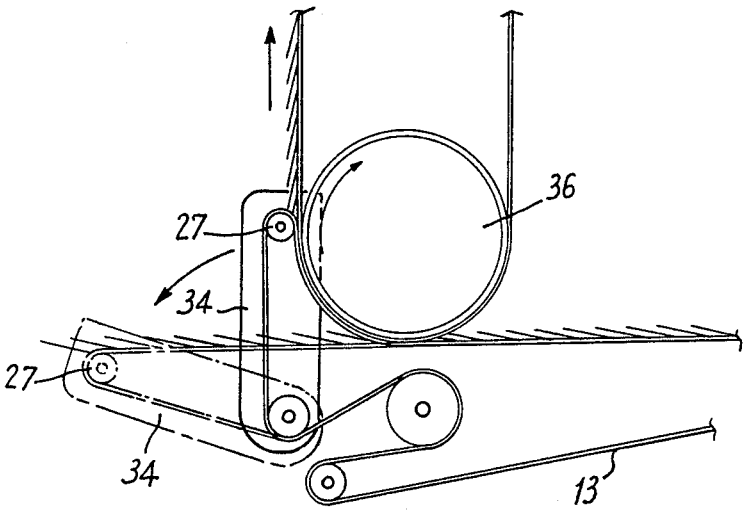
FIGS. 4 and 5 are diagrams of variant embodiments of the machine.
Figure 5:
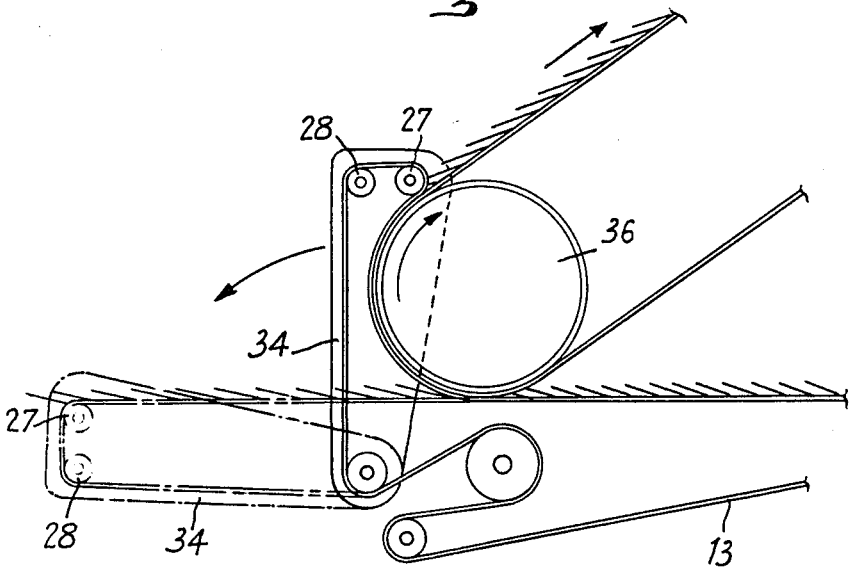

The separation device shown in FIG. 3 may also be used with a device which no longer ensures a return through 180°, as shown in FIG. 1A, but simply a deviation of the line of blanks throught 90° (FIG. 4), in order thus to form an ascending line of blanks, or through another angle greater than 90°, for example 120° (FIG. 5).

What is claimed is:

1. A machine for receiving and stacking blanks of cardboard or like material of variable shape and format, cut out successively from a continuous web by a cutting-out apparatus located upstream of the machine, supplied in a continuous line in an overlapping relationship one onto another on an endless conveyor belt, comprising:

a device for deviating the blanks through at least 90°;

parallel mobile endless belts extending between the outlet of said blank deviating device and a transverse stacking stop which stops the successive blanks which engage one after the other the stack of blanks already formed;

said blank deviating device comprising a drum which rotates about a horizontal and transverse axis, around which passes said mobile endless belts extending up to said stacking stop; and said endless conveyor belt being tangential to said drum, therebeneath, and passing around a motorized drive roller and guide rollers having horizontal and transverse axes wherein at least one of the guide rollers is borne by a chassis mounted to pivot about said drum, so that the pivoting chassis may occupy two positions;

one of said two positions being a first horizontal position in which the chassis extends along the longitudinal axis of the machine, so that said endless conveyor belt extends horizontally outside the machine, to allow a continuous outlet, in the horizontal direction, of the line of blanks; and the other of said two positions being a second vertical position in which said parallel mobile endless belts are applied against said drum and said endless conveyor belt, and said endless conveyor belt being maintained applied against at least the lower quarter of the peripheral surface of said drum so that, when the pivoting chassis is in this second vertical position, the line of blanks is driven between said endless conveyor belt and said mobile endless belts along at least the lower and outer quarter of the peripheral surface of said drum to be deviated through at least 90° and then is directed, by said mobile endless belts, towards said stacking stop so that the blanks are maintained and pinched between said mobile endless belts and said endless conveyor belt while maintaining their overlapping relationship.

2. The machine of claim 1, including:

a separating device upstreaam of said deviating device;

said separating device being placed at the joinder of an intermediate conveyor belt and of said endless conveyor belt which is in contact with said drum, said intermediate conveyor belt passing over an upstream guide roller having a horizontal and transverse axis, which extends opposite and at the same level as another downstream guide roller, having a horizontal and transverse axis, provided for said intermediate conveyor belt;

said separating device comprising a lower catch, located normally, between said upstream and downstream guide rollers, flush with the upper sides of said intermediate and endless conveyor belts or under these sides and which may be raised by a jack and, above the guide rollers, a first lever which bears a horizontal plate, and a second lever which bears a stop and against which is applied said first lever, under the action of a spring; and said first and second levers being mounted to pivot about a horizontal and transverse axis, said second lever being adapted to be lowered by a jack, and said second lever also bearing at least one presser roller disposed above the endless conveyor belt and which may be lowered jointly with said second lever, so as to create, by lowering the stop and raising the catch, a rupture in the continuity of the line of blanks in the vertical direction and consequently a "hole" in this line.

3. The machine of claim 1, including:

a separating device upstream of said deviating device separating the continuous line of blanks into successive groups of blanks each corresponding to a predetermined number of blanks intended to substantially form an individual stack;

said separating device provoking, between two successive groups, a "hole" whose passage is then detected by a photoelectric sensor placed at the outlet of the deviating device and upstream of the stacking stop;

said stacking stop being mounted on a support vertically mobile under the control of a jack so as to be able to be lowered beneath the plane of the mobile endless belts when a stack of blanks has been formed, wherein a transverse evacuation stop is disposed downstream of said stacking stop to stop the individual stacks; and a device for lateral evacuation of the stacks of blanks upstream of the evacuation stop comprising, between said stacking stop and said stack evacuation stop, a support mobile vertically on the frame of the machine, means for vertically displacing said support, longitudinal rollers mounted to rotate on said support, located between said mobile endless belts, and means for driving said longitudinal rollers in rotation.

4. The machine according to claim 1, wherein said endless conveyor belt passes over first and second upper guide rollers, borne by said pivoting chassis, then over a third lower guide roller about the axis of which the chassis may pivot, then over the drive roller and over a fourth lower tension guide roller, with adjustable position, in order to adjust the tension of the endless conveyor belt, to return to a fifth upstream guide roller.

5. The machine according to claim 4, wherein said fourth lower tension roller is borne by a pair of parallel arms articulated about a horizontal and transverse axis, and which are actuated by a horizontal and longitudinal tension jack mounted in the lower part of the frame of the machine.

6. The machine according to claim 1, including means for spacing said evacuation stop from a stack of blanks formed before said longitudinal rollers are driven in rotation.

7. The machine according to claim 1, including:

a device for separating a stack in the course of formation, said separating device being positioned to the rear of said stacking stop and in a position thereadjacent;

said separating device comprising at least one blade adapted to be displaced horizontally and longitudinally and in a reciprocating manner in a horizontal plane, so as to be introduce, above said stacking stop, between two superimposed blanks while the stack is being continuously formed, so as to isolate, from this stack, an upper part containing a predetermined number of blanks and which may be taken up by lateral evacuation means.

8. The machine according to claim 7, wherein said separating device comprises a pusher actuated by a jack and which is disposed so as to be able to raise the rear part of one of the blanks of the stack being continuously formed in order to facilitate introduction of the separating blade, said pusher being inclined at an angle between 15° to 30° with respect to the vertical, in the direction of the stack of blanks.

9. The machine according to claim 1, comprising, in its upper part means to facilitate formation of the stacks, said means including at least one roller or plate mounted on a longitudinally adjustable support and adapted to be pressed downwardly by a jack, said roller or plate cooperating with said parallel mobile endless belts and being intended to exert a pressure on the blanks located on the upper side of said parallel moble endless belts, in an apropriate position varying longitudinally as a function of the format of the blanks, said support serving as a vertical guide for the upstream side of the stack in the course of formation.

10. A machine for receiving and stacking blanks of cardboard or like material of variable shape and format, cut out successively from a continuous web by a cutting-out apparatus located upstream of the machine, supplied in a continuous line in an overlapping relationship one onto another on an endless conveyor belt, comprising:

a device for deviating the blanks through at least 90°;

parallel mobile endless belts extending between the outlet of the blank deviating device and a transverse stacking stop which stops the successive blanks which engage one after the other the stack of blanks already formed;

said blank deviating device comprising a drum which rotates about a horizontal and transverse axis, around which passes said mobile endless belts extending up to said stacking stop;

said endless conveyor belt being tangential to said drum, therebeneath, and passing around a motorized drive roller and guide rollers having horizontal and transverse axes wherein at least one of the guide rollers is borne by a chassis mounted to pivot about said drum, so that the pivoting chassis may occupy two positions, namely a first horizontal position in which it extends along the longitudinal axis of the machine, so that said endless conveyor belt extends horizontally outside the machine, to allow a continuous outlet, in the horizontal direction, of the line of blanks, and a second vertical position in which said endless conveyor belt is maintained applied against at least the lower quarter of the peripheral surface of said drum so that, when the pivoting chassis is in this second vertical position, the line of blanks is driven between said endless conveyor belt and the mobile endless belts along at least the lower and outer quarter of the peripheral surface of the drum to be deviated through at least 90° and then is directed, by the mobile endless belts, towards the stacking stop;

a device upstream of said deviating device separating the continuous line of blanks into successive groups of blanks each corresponding to a predetermined number of blanks intended to substantially form an individual stack;

said separating device provoking, between two successive groups, a "hole" whose passage is then detected by a photoelectric sensor placed at the outlet of the deviating device and upstream of the stacking stop;

said stacking stop being mounted on a support vertically mobile under the control of a jack so as to be able to be lowered beneath the plane of the parallel mobile endless belts when a stack of blanks has been formed, wherein a transverse evacuation stop is disposed downstream of said stacking stop to stop the individual stacks; and a device for lateral evacuation of the stacks of blanks upstream of the evacuation stop comprising, between said stacking stop and said stack evacuation stop, a support mobile vertically on the frame of the machine, means for vertically displacing this support, longitudinal rollers mounted to rotate on the support, being located between the mobile endless belts, and means for driving the longitudinal rollers in rotation;

said separating device being placed at the joinder of an intermediate conveyor belt and of said endless conveyor belt which is in contact with the drum, said intermediate conveyor belt passing over an upstream guide roller having a horizontal and transverse axis, which extends opposite and at the same level as another downstream guide roller, having a horizontal and transverse axis, provided for the intermediate conveyor belt;

said separating device comprising a lower catch, located normally, between said upstream and downstream guide rollers, flush with the upper sides of said intermediate and endless conveyor belts or under these sides and which may be raised by a jack and, above the guide rollers, a first lever which bears a lower horizontal plate, and a second lever which bears a stop and against which is applied said first lever, under the action of a spring; and said two levers being mounted to pivot about a horizontal and transverse axis, said second lever being adapted to be lowered by a jack, said second lever also bearing at least one presser roller disposed above the endless conveyor belt and which may be lowered jointly with said second lever, so as to create, by lowering the stop and raising the catch, a rupture in the continuity of the line of blanks in the vertical direction and consequently a "hole" in this line.

11. The machine according to claim 10, wherein said endless conveyor belt passes over first and second upper guide rollers, borne by said pivoting chassis, then over a third lower guide roller about the axis of which the chassis may pivot, then over the drive roller and over a fourth lower tension guide roller, with adjustable position, in order to adjust the tension of the endless conveyor belt, to return to a fifth upstream guide roller.

12. The machine according to claim 11, wherein said lower tension roller is borne by a pair of parallel arms articulated about a horizontal and transverse axis, and which are actuated by a horizontal and longitudinal tension jack mounted in the lower part of the frame of the machine.

13. The machine according to claim 10, including means for spacing said evacuation stop from a stack of blanks formed before said longitudinal rollers are driven in rotation.

14. The machine according to claim 10, including:

a device for separating a stack in the course of formation, said separating device being positioned to the rear of said stacking stop and in a position thereadjacent; and said separating device comprising at least one blade adapted to be displaced horizonally and in a reciprocating manner in a horizontal plane, so as to be introduced, above said stacking stop, between two superimposed blanks of a continuously forming stack, so as to isolate, from this stack, an upper part containing a predetermined number of blanks and which may be taken up by lateral evacuation means.

15. The machine according to claim 14, wherein said separating device comprises a pusher actuated by a jack and which is disposed so as to be able to raise the rear part of one of the blanks of the continuously formed stack, in order to facilitate introduction of the separating blade, said pusher being inclined at an angle between 15° to 30° with respect to the vertical, in the direction of the stack of blanks.

16. The machine according to claim 10, comprising, in its upper part, at least one roller or plate mounted on a longitudinally adjustable support and adapted to be pressed downwardly by a jack, said roller or plate being intended to exert a pressure on the blanks located on the upper side of the moble endless belts, in an appropriate position varying longitudinally as a function of the format of the blanks, said support serving as a vertical guide for the upstream side of the stack in the course of formation.

17. A machine for receiving and stacking blanks of cardboard or like material of variable shape and format, cut out successively from a continuous web by a cutting-out apparatus located upstream of the machine; comprising:

an endless conveyor belt for receiving the blanks in a continuous line in an overlapping relationship one onto another;

a device for deviating the blanks through at least 90°;

parallel moble endless belts extending between the outlet of said blank deviating device and a transverse stacking stop which stops the successive blanks which engage one after the other the stack of blanks already formed;

said blank deviating device comprising a drum which rotates about a horizontal and transverse axis, around which passes said mobile endless belts extending up to said stacking stop;

said endless conveyor belt being tangential to said drum, therebeneath, and passing around a motorized drive roller and guide rollers having horizontal and transverse axes wherein at least one of the guide rollers is borne by a chassis mounted to pivot about said drum, so that the pivoting chassis may occupy two positions, namely a first horizontal position in which it extends along the longitudinal axis of the machine, so that said conveyor belt extends horizontally outside the machine, to allow a continuous outlet, in the horizontal direction, of the line of blanks, and a second vertical position in which said endless belt is maintained applied against at least the lower quarter of the peripheral surface of said drum so that, when the pivoting chassis is in this second vertical position, the line of blanks is driven between said endless conveyor belt and the mobile endless belts along at least the lower and outer quarter of the peripheral surface of the drum to be deviated through at least 90° and then is directed, by the mobile endless belts, towards said stacking stop; and a separating device upstream of said deviating device separating the continuous line of blanks into successive groups of blanks each corresponding to a predetermined number of blanks intended to substantially form an individual stack;

said separating device being placed at the joinder of an intermediate conveyor belt and of said endless conveyor belt which is in contact with the drum, said intermediate conveyor belt passing over an upstream guide roller having a horizontal and transverse axis, which extends opposite and at the same level as another downstream guide roller, having a horizontal and transverse axis, provided for the intermediate conveyor belt;

said separating device comprising a lower catch, located normally, between said upstream and downstream guide rollers, flush with the upper sides of said intermediate and endless conveyor belts or under these sides and which may be raised by a jack and, above the guide rollers, a first lever which bears a lower horizontal plate, and a second lever which bears a stop and against which is applied said first lever, under the action of a spring; and said two levers being mounted to pivot about a horizontal and transverse axis, said second lever being adapted to be lowered by a jack, said, second lever also bearing at least one presser roller disposed above the conveyor belt and which may be lowered jointly with said second lever, so as to create, by lowering the stop and raising the catch, a rupture in the continuity of the line of blanks in the vertical direction and consequently a "hole" in this line.

18. The machine according to claim 17, including:

a device for separating a stack in the course of formation, said separating device being positioned to the rear of said stacking stop and in a position thereadjacent; and said separating device comprising at least one blade adapted to be displaced horizontally and in a reciprocating manner in a horizongtal plane, so as to be introduced, above said stacking stop, between two superimposed blanks of a continuously forming stack, so as to isolate, from this stack, an upper part containing a predetermined number of blanks and which may be taken up by lateral evacuation means.

19. The machine according to claim 18, wherein said separating device comprises a pusher actuated by a jack and which is disposed so as to be able to raise the rear part of one of the blanks of the continuously formed stack, in order to facilitate introduction of the separating blade, said pusher being inclined at an angle between 15° to 30° with respect to the vertical, in the direction of the stack of blanks.

20. The machine according to claim 17, comprising, in its upper part, at least one roller or plate mounted on a longitudinally adjustable support and adapted to be pressed downwardly by a jack, said roller or plate being intended to exert a pressure on the blanks located on the upper side of the moble endless belts, in an appropriate position varying longitudinally as a function of the format of the blanks, said support serving as a vertical guide for the upstream side of the stack in the course of formation.

* * * * *